US005897479A

United States Patent [19]

Sinn

[11] Patent Number: 5,897,479

[45] Date of Patent: Apr. 27, 1999

[54] PUNCHING AND SCORING TOOL FOR PRODUCTION OF SCORED PUNCHED PARTS

[75] Inventor: Rolf Sinn, Leingarten, Germany

[73] Assignee: Karl Marbach GmbH & Co., Germany

[21] Appl. No.: 08/800,828

[22] Filed: Feb. 13, 1997

[30] Foreign Application Priority Data

Feb. 16, 1996 [DE] Germany ..... 196 05 850
Apr. 18, 1996 [DE] Germany ..... 196 15 326

[51] Int. Cl.[6] ..... B26F 1/44; B31B 1/14

[52] U.S. Cl. ..... 493/61; 493/354; 83/684; 83/862; 76/107.8

[58] Field of Search ..... 83/862, 55, 879, 83/880, 883, 684, 695; 493/59, 61, 62, 473, 340, 363, 372, 354; 76/107.8; 69/2; 101/163, 390

[56] References Cited

U.S. PATENT DOCUMENTS

| | | | |
|---|---|---|---|
| 360,674 | 4/1887 | Fiske | 83/862 X |
| 1,661,807 | 3/1928 | Messmer, Jr. | 69/2 |
| 2,663,180 | 12/1953 | Benedict | 69/2 |
| 3,043,165 | 7/1962 | Tracey et al. | 76/107.8 |
| 4,100,844 | 7/1978 | Spengler | 493/472 |
| 4,850,950 | 7/1989 | Holliday | 493/475 |

FOREIGN PATENT DOCUMENTS

| | | |
|---|---|---|
| 2315368 | 6/1976 | France . |
| 3831393C2 | 6/1990 | Germany . |
| 3928916C1 | 1/1991 | Germany . |
| 9002692 | 7/1992 | Netherlands . |

*Primary Examiner*—Clark F. Dexter
*Attorney, Agent, or Firm*—Rothwell, Figg, Ernst & Kurz, p.c.

[57] ABSTRACT

The punching and scoring tool produces scored punched parts from a material sheet and has a carrier board, which is provided on its underside with punching elements and a scoring plate, on the underside of which scoring projections are arranged. A punching/scoring plate, in which scoring grooves are formed under the scoring projections, is provided under the carrier board. Leveling bushes are provided in the carrier board and bear against the scoring plate to provide an accurate supporting plane for the scoring plate.

6 Claims, 1 Drawing Sheet

PUNCHING AND SCORING TOOL FOR PRODUCTION OF SCORED PUNCHED PARTS

BACKGROUND OF THE INVENTION

1. Field of the Invention

This invention relates to a punching and scoring tool for production of scored punched parts.

2. Description of the Related Art

Cardboard folding box blanks are usually provided with scores, which give the folding boxes their defined shape when they are subsequently erected. The contours as well as necessary incisions in the folding box blank are produced by punching. Manufacture is by strip steel punching and scoring tools on flat-bed or rotary punches.

The strip steel punching and scoring tools usually consist of a carrier board made e.g. from wood, composites of plastics with glass fabric or reinforced with metal plates in sandwich construction. Slots to receive punching or scoring rules are provided in these carrier boards according to the box contours. The punching rules project exactly as far as or further than the scoring rules from the carrier board. The punching rules operate against a punching/scoring plate made in most instances from steel.

Such tools are described for example, in patents DE 39 28 916 C1 or DE 38 31 393.

The scoring rules produce a scoring ridge in the folding box material by forcing the latter into a scoring groove. These scoring grooves can be cut into the punching/scoring plate or mounted as an attachment on the punching/scoring plate. The folding box material should be foldable accurately and with a defined folding resistance along the scores. The folding process is particularly important in automatic cartoning machines, because the attainable operating speed of the automatic cartoning machines depends on the accuracy and folding behaviour of the scores.

Problems in the production of accurate scoring rules result from the interaction of scoring rules and the scoring groove in the case of the already known steel strip punching and scoring tools. The scoring rule is an integral part of the carrier board, whereas the scoring grooves are mounted on the punching/scoring plate. The slots to receive the scoring rules are cut into the carrier board, e.g. with a numerically controlled laser. With the same program the scoring grooves are cut into the punching/scoring plate with numerical control. When aligning the carrier board with the punching/scoring plate it is nevertheless impossible to prevent the scoring rules in the carrier board not always being accurately centred with the associated scoring groove. This is unavoidable, because the scoring rules are held in the slots in the carrier board by a clamp fit. Consequently lateral stresses, which result in slight displacements, occur in the case of a large number of parallel scoring rules. The scoring rules must therefore be re-adjusted by hand or the scoring groove widths must be adapted accordingly. However, this is unfavourable, because the narrowest possible score is required to achieve an accurate and symmetrical folding edge.

SUMMARY OF THE INVENTION

The object of the invention is to provide a punching and scoring tool for production of scored punched parts with a high score quality.

This object is obtained by a punching and scoring tool for production of scored punched parts from a material sheet, comprising a carrier board, on the underside of which punching elements and scoring elements are provided, a punching/scoring plate provided under the carrier board, scoring grooves being formed in said punching/scoring plate under said scoring elements, wherein said scoring elements are formed by scoring projections on the underside of a scoring plate mounted on the underside of said carrier board.

The refinement of the punching and scoring tool according to the invention permits accurate alignment of the scoring projections in relation to the scoring grooves formed in the punching/scoring plate. Only slots for the punching elements need be provided in the carrier board. Consequently the number of slots is clearly reduced, so that the carrier board has a high rigidity, which ensures accurate alignment of the scoring rules.

A special scoring plate can be provided for each type of blank to be punched.

If centring holes, which are aligned with first centring openings formed in the punching/scoring plate when the scoring plate is arranged in such a way that the scoring projections are aligned accurately with the corresponding scoring grooves, are provided in the scoring plate, locating pins passing through the centring holes and first centring openings can be used for fixing the scoring plate on the punching/scoring plate. The distance between the scoring plate and the punching/scoring plate can be adjusted by spacers, through which the locating pins pass.

The carrier board can be aligned accurately with the punching/scoring plate by means of locating pins, if centring holes in alignment with second centring openings formed in the punching/scoring board are provided in the carrier board. Consequently it is possible to join the carrier board in an accurately defined position to the scoring plate fixed on the punching/scoring plate.

This joint can be made temporarily by an adhesive, preferably double-sided adhesive tape, provided between the carrier board and scoring plate.

After the temporary securing, the scoring plate can be screwed to the carrier board for the final securing.

BRIEF DESCRIPTION OF THE DRAWINGS

An exemplified embodiment of the invention is explained in more detail below on the basis of drawings.

DETAILED DESCRIPTION OF THE PREFERRED EMBODIMENTS

Figure 1:
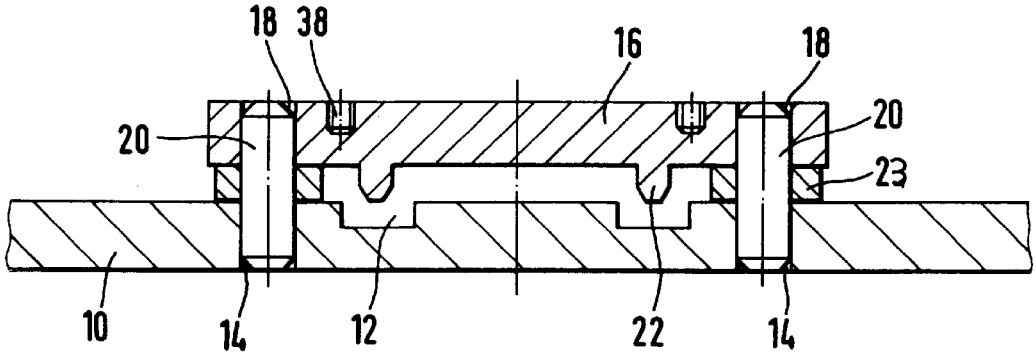
FIG. 1 shows a cross-section of a scoring plate fixed on a punching/scoring plate for a blank.

The punching/scoring plate 10 shown in FIG. 1 is mounted horizontally on a counter-pressure plate (not shown) of a punching and scoring tool. Several scoring grooves 12 for the formation of scores in a flat material to be processed, e.g. in cardboard, are provided in the surface of the punching/scoring plate 10. Four vertical first centring openings 14, in each of which a locating pin 20 is inserted, are provided in the punching/scoring plate 10 outside the area with scoring grooves 12. A scoring plate 16, in which vertical centring holes 18, which are aligned with the first centring openings 14 in the punching/scoring plate 10, have the same diameter as these openings and in which a corresponding locating pin 20 inserted in a first centring opening 14 engages, is arranged above the punching/scoring plate.

Each locating pin 20 passes through a spacer 23 arranged between the scoring plate 16 and the punching/scoring plate 10.

Scoring projections 22, each of which is aligned accurately with the corresponding scoring groove 12, are arranged on the underside of the scoring plate 16 opposite the scoring grooves 12. The distance of the free end of the scoring projections 22 from the base of the respective scoring groove 12 is dependent on the flat material to be scored as well as the depth of the scoring groove 12. This distance can be adjusted by the spacers 23.

To fix the scoring plate 16 on the punching/scoring plate 10 the locating pins 20 are inserted in the first centring openings 14 in such a way that they project from the top of the punching/scoring plate 10. The spacers 23 are subsequently placed on the locating pins 20.

Finally, the scoring plate 16 is pushed on to the locating pins 20, which engage in the centring holes 18.

The scoring projections 22 provided on the underside of the scoring plate 16 are aligned precisely with the scoring grooves 12 in this position.

Figure 2:
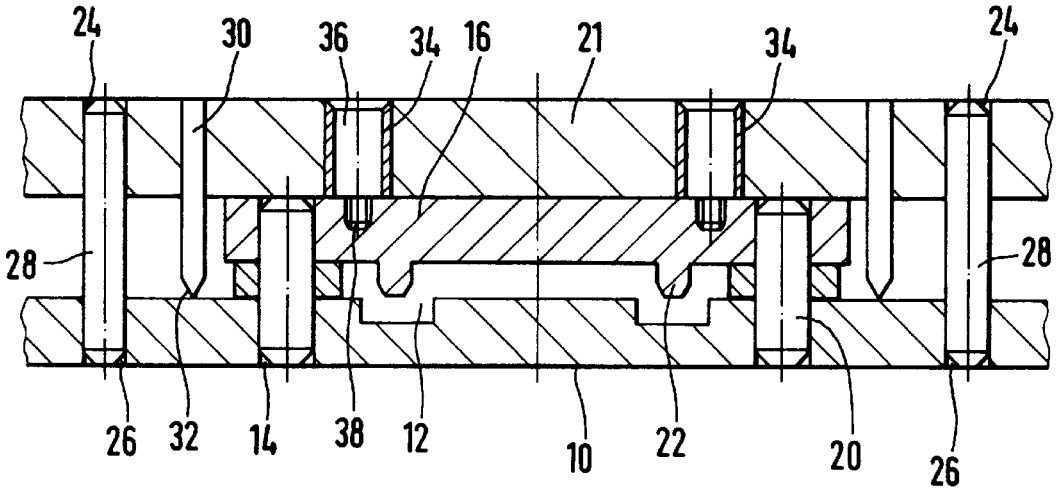
FIG. 2 shows a partial section of the joint of a carrier board to the scoring plate in FIG. 1.
Figure 3:
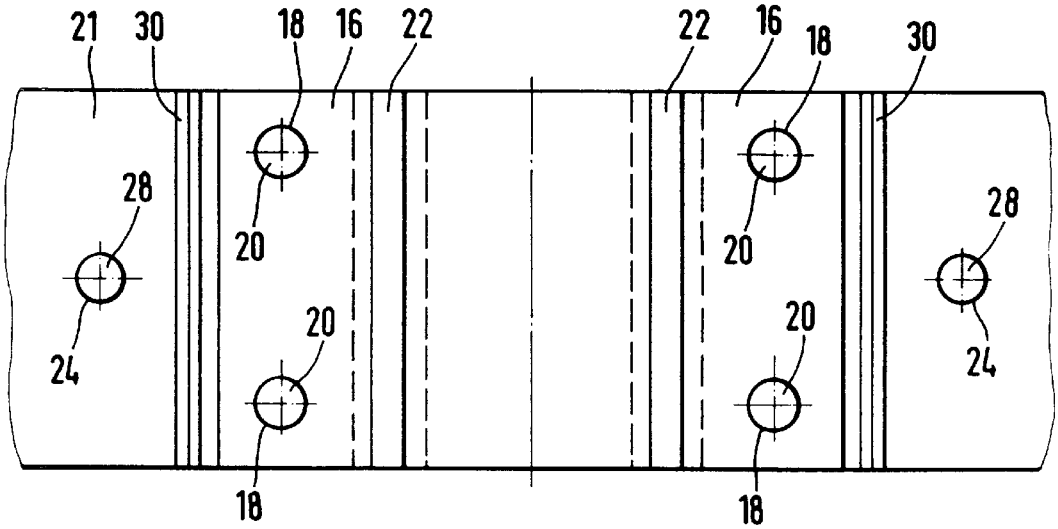
FIG. 3 shows a view of the underside of the scoring plate secured to the carrier board.

The carrier board 21 is then placed on the scoring plate 16 or on several scoring plates (in the case of several types of blanks), as shown in FIG. 2. Holes, in which levelling bushes 34 are secured by a clamp fit (i.e., friction fit), their bottom ends lying in one plane and projecting slightly from the underside of the carrier board 21, are provided in the carrier board 21 in the area above the scoring plate 16.

Centring holes 24, which are aligned with second centring openings 26 in the punching/scoring plate 10 and have the same diameters as these openings, are provided in the carrier board 21. The carrier board 21 is fixed by means of locating pins 28 on the punching/scoring plate 10, which engage in each centring hole 24 and the corresponding second centring opening 26.

Several slots, in which a punching rule 30 is inserted in such a way that its back is flush with the top of the carrier board 21 and the cutting edge 32 facing the punching/scoring plate 10 contacts the punching plate 10 when the carrier board 21 rests on the scoring plate 16, are formed in the carrier board 21. A double-sided adhesive tape (not shown), with which the scoring plate 16 is fixed temporarily on the ends of the levelling bushes 34 in the carrier board 21, is arranged between the scoring plate 16 and the carrier board 21.

After the temporary fixing, the carrier board 21 with the scoring plate 16 secured to it is lifted off the punching/scoring plate 10 and the locating pins 20 and 28 removed. The scoring plate 16 temporarily secured to the carrier board 21 by the adhesive tape is now firmly secured to the carrier board 21 by screws (not shown), which pass through the openings 36 of the levelling bushes 34 and engage in threaded holes 38, which are provided on the top of the scoring plate 16.

If several scoring plates 16 are secured in an exact position on the carrier board 21 in this way, only a single alignment of the carrier board 21, which is joined to a pressure plate, is required for alignment of the scoring projections 22 with the corresponding scoring grooves 12.

The levelling bushes 34 provide an accurate supporting plane, because the carrier board 21 may be uneven on its underside. If the carrier board 21 is absolutely flat on its underside, however, the levelling bushes 34 can be dispensed with and the scoring plate 16 can be secured directly to the carrier board 21.

I claim:

1. A punching and scoring tool for production of scored, punched parts from a material sheet, comprising a carrier board having an underside with punching elements extending therefrom, at least one scoring plate mounted to the underside of said carrier board, said at least one scoring plate having an underside with scoring projections extending therefrom, said at least one scoring plate further having a top side, and a punching/scoring plate positioned under the carrier board, said punching/scoring plate including scoring grooves positioned under said scoring projections and aligned with respective scoring projections, wherein said carrier board includes leveling elements having bottom ends which are arranged in one plane and said scoring plate is mounted to the underside of said carrier board with the top side of said scoring plate bearing against said bottom ends.

2. A punching and scoring tool according to claim 1, wherein centering holes are provided in said scoring plate, centering openings are formed in said punching/scoring plate, and said centering holes are aligned with said centering openings.

3. A punching and scoring tool according to claim 1, wherein centering holes are provided in said carrier board, centering openings are formed in said punching/scoring plate, and said centering holes are aligned with said centering openings.

4. A punching and scoring tool for production of scored, punched parts from a material sheet, comprising a carrier board having an underside with punching elements extending therefrom, at least one scoring plate mounted to the underside of said carrier board, said at least one scoring plate having an underside with scoring projections extending therefrom, said at least one scoring plate further having a top side, and a punching/scoring plate positioned under the carrier board, said punching/scoring plate including scoring grooves positioned under said scoring projections and aligned with respective scoring projections, wherein said carrier board includes leveling elements having bottom ends which are arranged in one plane and said scoring plate is mounted to the underside of said carrier board with the top side of said scoring plate bearing against said bottom ends, and wherein centering holes are provided in said scoring plate, centering openings are formed in said punching/scoring plate, and said centering holes are aligned with said centering openings.

5. A punching and scoring tool for production of scored, punched parts from a material sheet, comprising a carrier board having an underside with punching elements extending therefrom, at least one scoring plate mounted to the underside of said carrier board, said at least one scoring plate having an underside with scoring projections extending therefrom, said at least one scoring plate further having a top side, and a punching/scoring plate positioned under the carrier board, said punching/scoring plate including scoring grooves positioned under said scoring projections and aligned with respective scoring projections, wherein said carrier board includes leveling elements having bottom ends which are arranged in one plane and said scoring plate is mounted to the underside of said carrier board with the top side of said scoring plate bearing against said bottom ends, and wherein centering holes are provided in said carrier board, centering openings are formed in said punching/scoring plate, and said centering holes are aligned with said centering openings.

6. A punching and scoring tool for production of scored, punched parts from a material sheet, comprising a carrier board having an underside with punching elements extending therefrom, at least one scoring plate mounted to the underside of said carrier board, said at least one scoring plate having an underside with scoring projections extending therefrom, said scoring plate further having a top side, and a punching/scoring plate positioned under the carrier board, said punching/scoring plate including scoring grooves positioned under said scoring projections and aligned with respective scoring projections, wherein said carrier board includes leveling elements having bottom ends which are arranged in one plane and said scoring plate is mounted to the underside of said carrier board with the top side of said scoring plate bearing against said bottom ends, wherein first centering holes are provided in said scoring plate, first centering openings are formed in said punching/scoring plate, and said first centering holes are aligned with said first centering openings, and wherein second centering holes are provided in said carrier board, second centering openings are formed in said punching/scoring plate, and said second centering holes are aligned with said second centering openings.

* * * * *